US009159514B2

(12) United States Patent
Weber et al.

(10) Patent No.: US 9,159,514 B2
(45) Date of Patent: Oct. 13, 2015

(54) RELAY CONNECTOR ASSEMBLY FOR A RELAY SYSTEM

(71) Applicant: Tyco Electronics Corporation, Berwyn, PA (US)

(72) Inventors: Ronald Martin Weber, Annville, PA (US); Christopher George Daily, Harrisburg, PA (US); Matthew Edward Mostoller, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/082,935

(22) Filed: Nov. 18, 2013

(65) Prior Publication Data

US 2015/0137918 A1 May 21, 2015

(51) Int. Cl.

| | |
|---|---|
| ***H01H 51/22*** | (2006.01) |
| ***H01H 50/04*** | (2006.01) |
| ***H01R 31/02*** | (2006.01) |

(52) U.S. Cl.

CPC ..... *H01H 50/048* (2013.01); *H01R 31/02* (2013.01)

(58) Field of Classification Search

CPC ..... H01H 2001/5861; H01H 1/5866; H01H 2050/362; H01H 71/082; H01H 2071/084

USPC ..... 335/78

See application file for complete search history.

(56) References Cited

U.S. PATENT DOCUMENTS 3,293,502 A * 12/1966 Beierle ..... 361/805
5,160,910 A * 11/1992 Tsuji ..... 335/129
5,579,211 A * 11/1996 Hendel ..... 361/819
5,719,541 A * 2/1998 Mader ..... 335/78
5,748,061 A * 5/1998 Tsutsui et al. ..... 335/83
5,907,268 A * 5/1999 Mader ..... 335/202
5,982,257 A * 11/1999 Vernier ..... 335/78
6,903,639 B2 * 6/2005 Sanada et al. ..... 335/129
6,914,503 B2 * 7/2005 Saruwatari et al. ..... 335/78
7,201,616 B2 * 4/2007 Smith ..... 439/830
7,205,870 B2 * 4/2007 Sanada et al. ..... 335/78
7,317,170 B2 * 1/2008 Neumann et al. ..... 200/305
7,335,040 B2 * 2/2008 Ota et al. ..... 439/188
7,780,475 B1 8/2010 Parker et al.

(Continued)

FOREIGN PATENT DOCUMENTS

EP 0 713 234 5/1996
EP 0 951 102 A2 10/1999

OTHER PUBLICATIONS

International Search Report, International Application No. PCT/US2014/065187, International Filing Date, Nov. 12, 2014.

*Primary Examiner* — Shawki S Ismail
*Assistant Examiner* — Lisa Homza

(57) ABSTRACT

A relay connector assembly configured to electrically connect a power supply and a load includes a housing having a bottom configured to be mounted to a circuit board, the housing having contact cavities. Power contacts are received in corresponding contact cavities and held by the housing. The power contacts have relay tab ends and terminating ends having interfaces configured to be terminated to high current power conductors of either the power supply or the load. A relay is coupled to the housing. The relay has coil contacts configured to be electrically connected to a coil circuit of the circuit board used to energize the relay. The relay has relay tabs being terminated to the relay tab ends of corresponding power contacts. The relay electrically connects corresponding power contacts when the relay is energized.

20 Claims, 4 Drawing Sheets

(56) References Cited

U.S. PATENT DOCUMENTS

| | | | | |
|---|---|---|---|---|
| 7,816,999 | B2 * | 10/2010 | Pashby et al. | 335/78 |
| 7,986,204 | B2 * | 7/2011 | Mader et al. | 335/78 |
| 8,362,857 | B2 * | 1/2013 | Tsutsui et al. | 335/78 |
| 8,421,561 | B2 * | 4/2013 | Shinoura | 335/4 |
| 8,704,621 | B2 * | 4/2014 | Hasegawa et al. | 335/78 |
| 2002/0036557 | A1 * | 3/2002 | Nakamura et al. | 335/128 |
| 2002/0175787 | A1 * | 11/2002 | Mader et al. | 335/131 |
| 2003/0075423 | A1 * | 4/2003 | Martinez | 200/17 R |
| 2004/0119566 | A1 * | 6/2004 | Sanada et al. | 335/128 |
| 2006/0082979 | A1 * | 4/2006 | Brandl et al. | 361/729 |
| 2007/0013467 | A1 * | 1/2007 | Mikl | 335/78 |
| 2010/0157567 | A1 * | 6/2010 | Lima | 361/819 |
| 2011/0254645 | A1 * | 10/2011 | Kubono | 335/127 |
| 2011/0256645 | A1 * | 10/2011 | Tam et al. | 438/14 |
| 2012/0120629 | A1 * | 5/2012 | Nakayama | 361/819 |
| 2012/0134130 | A1 * | 5/2012 | Washihira et al. | 361/819 |

* cited by examiner

RELAY CONNECTOR ASSEMBLY FOR A RELAY SYSTEM

BACKGROUND OF THE INVENTION

The subject matter herein relates generally to relay connector assemblies for relay systems.

Relay systems typically use high current relays to make and break a high current circuit between a power source and a load. Existing high current relays, such as those used in appliances, such as heaters, are typically soldered to a printed circuit board and rely on board traces to carry the high current to and from the relay. The high current traces typically run short distances on the printed circuit board before terminating in another terminal, such as a soldered tab, that is the power input/output for the printed circuit board. The high current traces need to be thick and wide to carry the high current, which takes up valuable board space. The manufacture of the traces requires a prolonged additive processes to plate up enough thickness to carry the high current. Manufacturing the high current traces adds to the manufacturing cost of the printed circuit board while also adding reliability concerns. For example, if the high current traces are not properly sized or the input/output connection is not properly soldered, the traces can catastrophically overheat.

A need remains for a relay system that is cost effective and reliable.

BRIEF DESCRIPTION OF THE INVENTION

In one embodiment, a relay connector assembly is provided that is configured to electrically connect a power supply and a load. The relay connector assembly includes a housing having a bottom configured to be mounted to a circuit board, the housing having contact cavities. Power contacts are received in corresponding contact cavities and held by the housing. The power contacts have relay tab ends and terminating ends having interfaces configured to be terminated to high current power conductors of either the power supply or the load. A relay is coupled to the housing. The relay has coil contacts configured to be electrically connected to a coil circuit of the circuit board used to energize the relay. The relay has relay tabs being terminated to the relay tab ends of corresponding power contacts. The relay electrically connects corresponding power contacts when the relay is energized.

Optionally, the power contacts may be separate from the circuit board. The power contacts may be configured to transmit the high current from the power supply to the load without transmitting the high current to the circuit board. The coil contacts may pass through the housing and extend below the bottom of the housing for direct termination to the circuit board.

Optionally, the relay tab ends may directly engage the relay tabs and the terminating ends may directly engage the high current power conductors. The housing may include a shroud configured to receive a power connector holding at least one high current power conductor. The terminating ends may be located within the shroud for termination to the high current power conductor held by the power connector.

Optionally, at least one of the housing and the power contacts may include a solder tab configured to be soldered to the circuit board to mechanically secure the relay connector assembly to the circuit board. The housing may include a mounting lug configured to mount the housing to the circuit board. Optionally, the power contacts may be entirely contained within the housing.

Optionally, the relay connector assembly may include coil terminals held in the housing. The coil terminals may be terminated to the coil circuit of the circuit board. The coil terminals may be terminated to the coil contacts of the relay to electrically connect the coil contacts of the relay to the coil circuit of the circuit board.

In another embodiment, a relay system is provided that includes a printed circuit board having a relay controller, a mounting area, and conductors defining a coil circuit between the relay controller and the mounting area. A relay connector assembly is mounted to the printed circuit board. The relay connector assembly is configured to electrically connect a power supply and a load. The relay connector assembly includes a housing having a bottom mounted to the mounting area of the circuit board and having contact cavities. The relay connector assembly includes power contacts received in corresponding contact cavities and held by the housing. The power contacts have relay tab ends and terminating ends with interfaces configured to be terminated to high current power conductors of either the power supply or the load. The relay connector assembly includes a relay coupled to the housing. The relay has coil contacts electrically connected to the coil circuit of the circuit board that are used to energize the relay. The relay has relay tabs being terminated to the relay tab ends of corresponding power contacts. The relay electrically connects corresponding power contacts when the relay is energized.

DETAILED DESCRIPTION OF THE INVENTION

Figure 1:
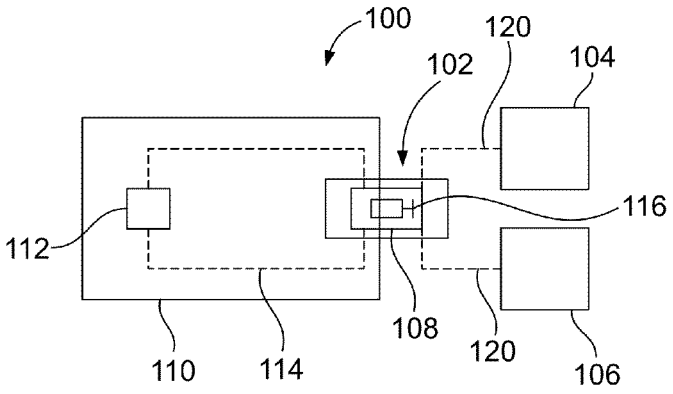
FIG. 1 is a schematic illustration of a relay system formed in accordance with an exemplary embodiment.

FIG. 1 is a schematic illustration of a relay system 100 formed in accordance with an exemplary embodiment. The relay system 100 includes a relay connector assembly 102 that is used to electrically connect a power supply 104 to a load 106 to power the load 106. The relay system 100 includes a relay 108 forming part of the relay connector assembly 102. The relay 108 is energized and de-energized to connect and break the electrical connection between the power supply 104 and the load 106.

The relay system 100 includes a circuit board 110 having a relay controller 112 for controlling the function of the relay 108. The circuit board 110 includes conductors, such as traces, pads, plated vias and the like, that define a coil circuit 114 between the relay controller 112 and the relay 108. The relay controller 112 controls the operation of the relay 108, such as by energizing the coil of the relay 108 to move a contactor 116 (e.g. armature, spring contact, and the like) of the relay 108 into or out of engagement with a high current power circuit 120. The high current power circuit 120 is used to supply power from the power supply 104 to the load 106 when the relay 108 is energized.

In an exemplary embodiment, the high current power circuit 120 is separate from the circuit board 110. None of the components defining the high current power circuit 120 are part of the circuit board 110. The high current transmitted by the high current power circuit 120 is not transmitted to the circuit board 110. The circuit board 110 does not include any conductors that conduct the high current of the high current power circuit 120. Instead, the relay connector assembly 102 includes components defining portions of the high current power circuit 120. For example, the relay 108 is part of the high current power circuit 120. The relay connector assembly 102 includes power contacts that are part of the high current power circuit 120. The relay 108 is electrically connected to the power supply 104 and the load 106 through the relay connector assembly 102, as opposed to being connected through the circuit board 110.

Figure 2:
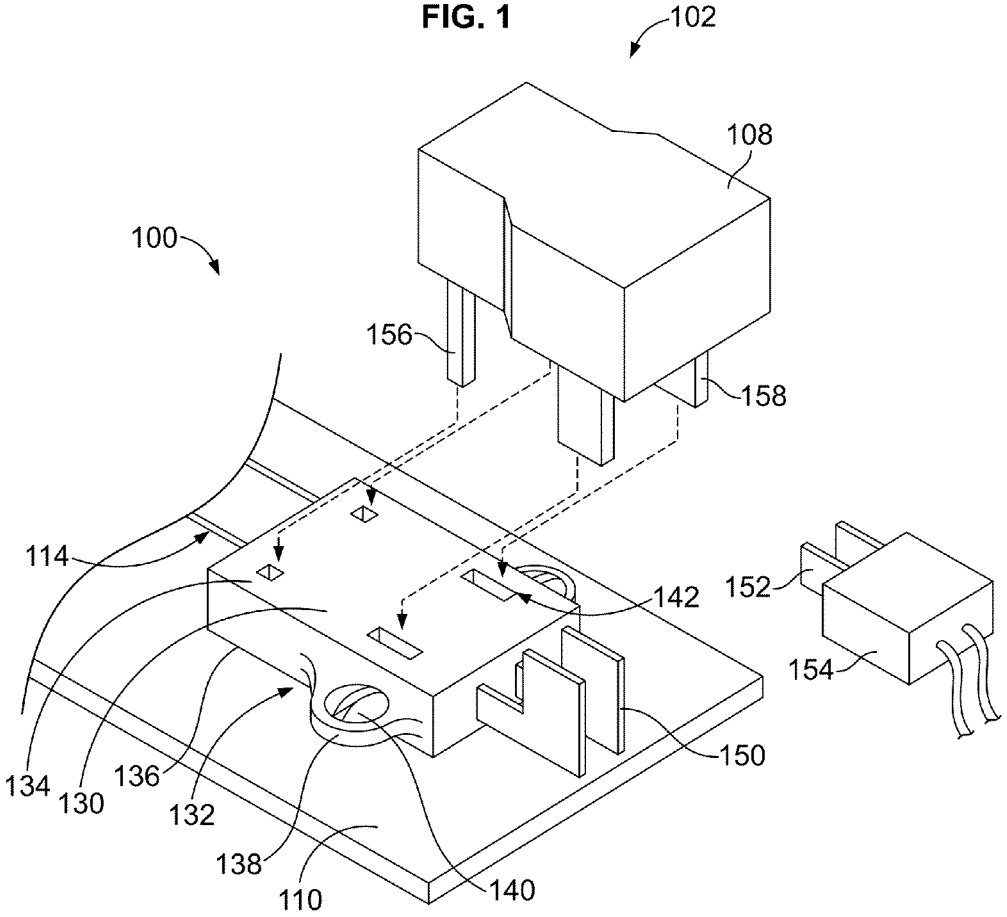
FIG. 2 is a top perspective view of a portion of the relay system showing a relay connector assembly mounted to a circuit board.

FIG. 2 is a top perspective view of a portion of the relay system 100 showing the relay connector assembly 102 mounted to the circuit board 110. The relay connector assembly 102 includes a housing 130 mounted to a mounting area 132 of the circuit board 110. Optionally, the housing 130 may be contained within the boundary or perimeter of the circuit board 110. Alternatively, at least a portion of the receptacle connector assembly 102 may extend beyond and hang over an edge of the circuit board 110, which may free up more space on the circuit board 110 for other electrical components.

The housing 130 is manufactured from a dielectric material, such as a plastic material. The housing 130 includes a top 134 and a bottom 136 opposite the top 134. The bottom 136 of the housing 130 is mounted to the mounting area 132 of the circuit board 110. In an exemplary embodiment, the housing 130 includes mounting lugs 138 extending from sides thereof that are secured to the circuit board 110 by fastener 140, such as threaded fasteners, solder tabs or other types of fasteners. The housing 130 may be secured to the circuit board 110 by other means in alternative embodiments. The housing 130 include channels 142 open at the top 134 that receives pins or tabs of the relay 108.

The relay connector assembly 102 includes power contacts 150 held in the housing 130. The power contacts 150 are configured to be electrically connected to corresponding pins or tabs of the relay 108 to electrically connect the relay 108 to the power contacts 150. The power contacts 150 are configured to be electrically connected to high current power conductors 152 of either the power supply 104 (shown in FIG. 1) or the load 106 (shown in FIG. 1). The high current power conductors 152 may be terminals or contacts, and may be held within a power connector 154 that is configured to be coupled to the relay connector assembly 102 at a removable or separable interface. Alternatively, the high current power conductors 152 may be wires or cables terminated to the power contacts 150, such as by soldering the high current power conductors 152 to the power contacts 150. Other types of high current power conductors may be provided in alternative embodiments to electrically connect the power supply 104 and/or the load 106 to the power contacts 150.

The relay 108 includes coil contacts 156 and relay tabs 158 extending therefrom. The coil contacts 156 and relay tabs 158 are configured to be received in corresponding channels 142 of the housing 130 when the relay 108 is coupled to the housing 130. The coil contacts 156 and relay tabs 158 may have any size and shape. For example, the coil contacts 156 and/or relay tabs 158 may be pins, rectangular blades, spring contacts, and the like.

The relay tabs 158 are configured to be electrically connected to corresponding power contacts 150 when the relay 108 is coupled to the housing 130. The coil contacts 156 are configured to be electrically connected to the coil circuit 114 of the circuit board 110 when the relay 108 is coupled to the housing 130. Optionally, the coil contacts 156 may directly engage conductors of the circuit board 110 that define the coil circuit 114. For example, the coil contacts 156 may be soldered to conductors of the circuit board 110. In alternative embodiments, the coil contacts 156 may be terminated to wires rather than directly to the coil circuit 114.

Figure 3:
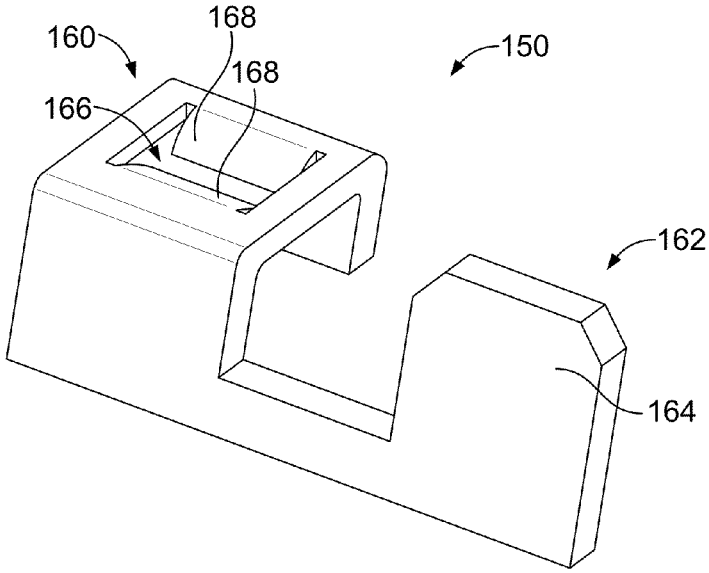
FIG. 3 is a perspective view of a power contact for the relay connector assembly and formed in accordance with an exemplary embodiment.

FIG. 3 is a perspective view of one of the power contacts 150 formed in accordance with an exemplary embodiment. The power contact 150 is manufactured from a conductive material such as a metal material. Optionally, the power contact 150 may be stamped and formed.

The power contact 150 extends between a relay tab end 160 and a terminating end 162. The terminating end 162 has an interface 164 configured to be terminated to the corresponding high current power conductor 152 (shown in FIG. 2). In the illustrated embodiment, the terminating end 162 is a rectangular blade that may be received in a corresponding socket of the high current power conductor 152. Alternatively, a wire may be soldered directly to the interfaces 164 at the terminating end 162. The terminating end 162 may have other shapes or features in alternative embodiments, such as a round pin.

The relay tab end 160 is configured to be electrically connected to the corresponding relay tab 158 of the relay 108 (both shown in FIG. 2). In the illustrated embodiment, the relay tab end 160 includes an opening 166 with one or more deflectable tabs 168 extending into the opening 166 to engage the relay tab 158 when the relay 108 is plugged into the opening 166. The relay tab end 160 may have other shapes or features in alternative embodiments for connecting to the relay tab 158 of the relay 108.

Figure 4:
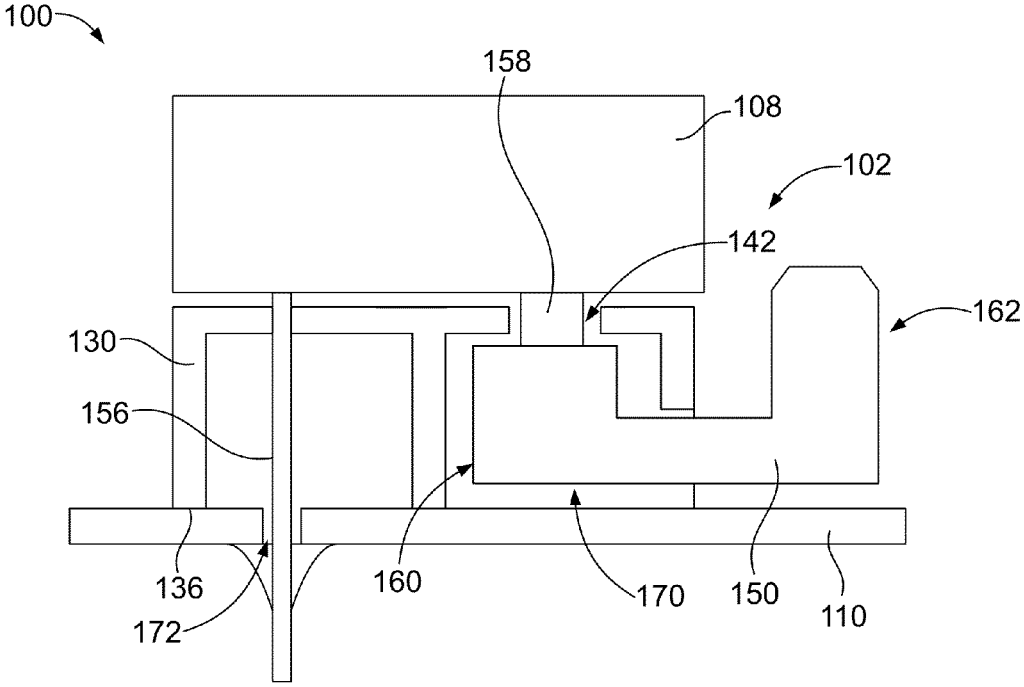
FIG. 4 is a cross sectional view of a portion of the relay system showing the relay connector assembly coupled to the circuit board.

FIG. 4 is a cross sectional view of a portion of the relay system 100 showing the relay connector assembly 102 coupled to the circuit board 110. When the relay 108 is coupled to the housing 130, the relay tabs 158 are mechanically and electrically coupled to the relay tab ends 160 of the power contacts 150 held by the housing 130. The electrical paths are routed from the relay tabs 158 directly to the power contacts 150 to bypass the circuit board 110. Therefore, the high current electrical path from the power source 104 to the load 106 is not routed through the circuit board 110. The circuit board 110 does not need to be designed to have high current conductors, such as thicker and/or wider traces on the circuit board 110. Real estate on the circuit board 110 is saved for other components, as opposed to high current conductors, and/or the circuit board 110 may be made smaller. The circuit board 110 may be manufactured cheaper without the need for high current conductors.

In an exemplary embodiment, the housing 130 includes contact cavities 170 that receive corresponding power contacts 150. The channels 142 through the housing 130 are open to the contact cavities 170. When the relay 108 is coupled to the housing 130, the relay tabs 158 extend through the channels 142 into the contact cavities 170 for connection to the power contacts 150. Optionally, the power contacts 150 may extend from the contact cavities 170 to an exterior of the housing 130, such as through an exterior side of the housing 130. As such, the terminating ends 162 of the power contacts 150 may be located outside of the housing 130. Alternatively, the power contacts 150 may be entirely contained within the housing 130. For example, the terminating ends 162 may be routed to a shroud that receives the power connector 154 for termination to the high current power conductors 152 held by the power connector 154.

When the relay 108 is coupled to the housing 130 the coil contacts 156 extend into corresponding channels 142 of the housing 130. The coil contacts 156 may extend through the housing 130 and beyond or below the bottom 136 of the housing 130 for direct termination to the circuit board 110. The coil contacts 156 may extend into corresponding vias 172 in the circuit board 110. The coil contacts 156 may be soldered to corresponding conductors of the circuit board 110 to thereby electrically connect the coil contacts 156 to the coil circuit 114 (shown in FIG. 1). Control signals from the relay controller 112 (shown in FIG. 1) may be transmitted from the coil circuit 114 to the coil contacts 156 to energize the relay 108.

Alternatively, rather than directly connecting the coil contacts 156 to the circuit board 110, the housing 130 may hold coil terminals (not shown), such as in terminal cavities in the housing 130, that are terminated to the circuit board 110 and that are terminated to the coil contacts 156 when the relay 108 is coupled to the housing 130.

Figure 5:
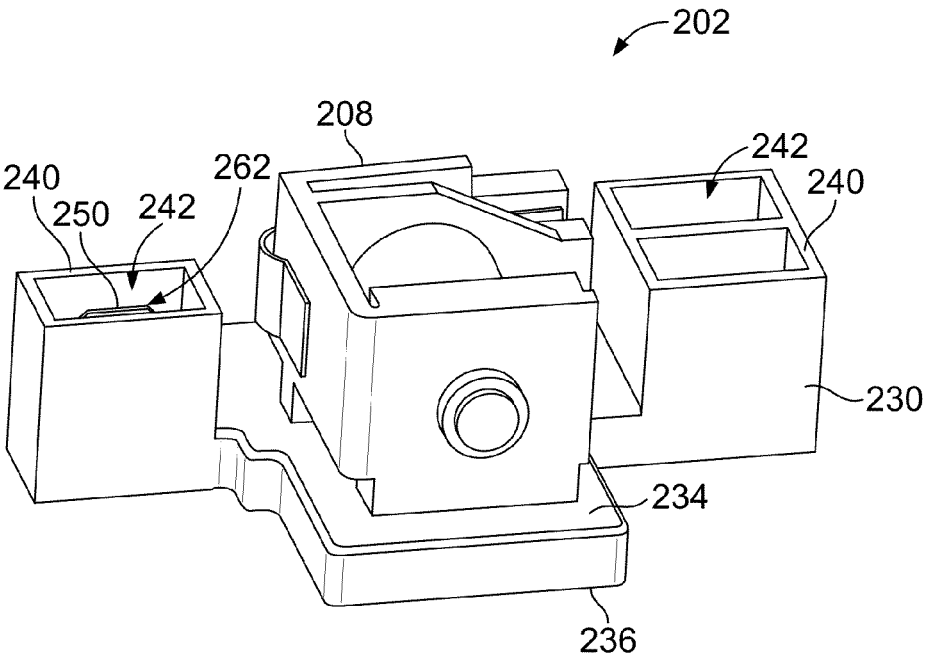
FIG. 5 is a top perspective view of a relay connector assembly formed in accordance with an exemplary embodiment.
Figure 6:
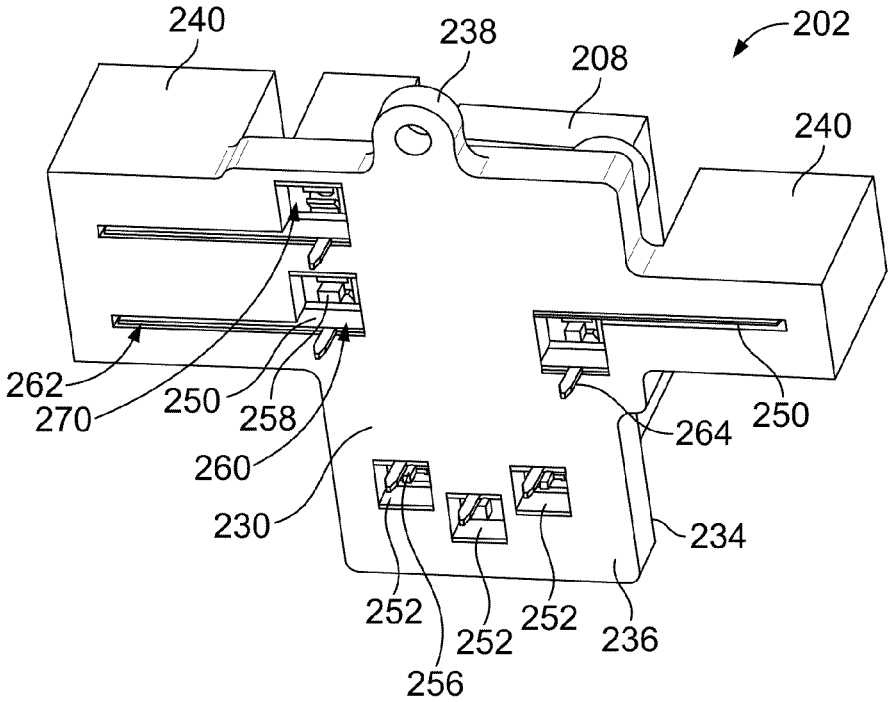
FIG. 6 is a bottom perspective view of the relay connector assembly shown in FIG. 5.

FIG. 5 is a top perspective view of a relay connector assembly 202 formed in accordance with an exemplary embodiment. FIG. 6 is a bottom perspective view of the relay connector assembly 202. The relay connector assembly 202 may be similar to the relay connector assembly 102 (shown in FIG. 2). The relay connector assembly 202 may be mounted to the circuit board 110 (shown in FIG. 2) and may be used to electrically connect the power supply 104 to the load 106 to power the load 106. The relay connector assembly 202 includes a relay 208 that is energized and de-energized to connect and break the electrical connection between the power supply 104 and the load 106.

The relay connector assembly 202 includes a housing 230 manufactured from a dielectric material, such as a plastic material. The housing 230 includes a top 234 and a bottom 236 opposite the top 234. Optionally, a cover (not shown) may be coupled to the bottom 236. In an exemplary embodiment, the housing 230 includes a mounting lug 238 extending from the sides thereof that receives a fastener, solder tab or other fastening means to secure the housing 230 to the circuit board 110. The housing includes shrouds 240 defining corresponding receptacles 242 that are configured to receive corresponding power connectors (not shown). The power connectors may be input and/or output connectors connected to the power supply 104 and/or the load 106.

The relay connector assembly 202 includes power contacts 250 and coil terminals 252 (shown in FIG. 6) held in the housing 230. The coil terminals 252 are configured to be electrically connected to corresponding pins or tabs of the relay 208 to electrically connect the relay 208 to the coil terminals 252. The coil terminals 252 are configured to be electrically connected to the coil circuit 114 (shown in FIG. 1) of the circuit board 110, such as by terminating pins or tails of the coil terminals 252 to the circuit board 110. For example, the pins of the coil terminals 252 may be through-hole mounted to corresponding vias in the circuit board 110 or attached by other means, such as being press-fit, surface mounted, soldered to pads, connected to wires, and the like.

The power contacts 250 are configured to be electrically connected to corresponding pins or tabs of the relay 208 to electrically connect the relay 208 to the power contacts 250. The power contacts 250 are configured to be electrically connected to high current power conductors of either the power supply 104 or the load 106. The high current power conductors may be terminals or contacts, and may be held within the power connector(s) that are coupled to the relay connector assembly 202. Alternatively, the high current power conductors may be wires or cables terminated directly to the power contacts 250, such as by soldering to the power contacts 250. Other types of high current power conductors may be provided in alternative embodiments to electrically connect the power supply 104 and/or the load 106 to the power contacts 250.

The relay 208 includes coil contacts 256 and relay tabs 258 extending therefrom. The relay tabs 258 are configured to be electrically connected to corresponding power contacts 250 when the relay 208 is coupled to the housing 230. The coil contacts 256 are configured to be electrically connected to corresponding coil terminals 252 when the relay 208 is coupled to the housing 230. The coil contacts 256 are electrically connected to the coil circuit 114 of the circuit board 110 by the coil terminals 252. Alternatively, the coil contacts 256 may directly engage conductors of the circuit board 110 that define the coil circuit 114. For example, the coil contacts 256 may be soldered to conductors of the circuit board 110.

The power contact 250 may be similar to the power contact 150 (shown in FIG. 3). The power contact 250 extends between a relay tab end 260 and a terminating end 262. The terminating end 262 has an interface configured to be terminated to the corresponding high current power conductor of the power supply 104 or the load 106. The relay tab end 260 is configured to be electrically connected to the corresponding relay tab 258 of the relay 208.

Optionally, the power contact 250 may include a solder tab 264 extending therefrom. The solder tab 264 is configured to be soldered to a corresponding solder pad or via (not shown) on the circuit board 110 to mechanically secure the power contact 250, and thus the relay connector assembly 202, to the circuit board 110. The connection to the circuit board 110 is merely mechanical and not electrical. No high current is routed to the circuit board 110 by the solder tab 264, but rather the high current circuit remains separate from, and is not routed through, the circuit board 110.

In an exemplary embodiment, the housing 230 includes contact cavities 270 (shown in FIG. 6) that receive corresponding power contacts 250. The solder tabs 264 may extend out of the contact cavities 270 for soldering to the circuit board 110. When the relay 208 is coupled to the housing 230, the relay tabs 258 extend into the contact cavities 270, such as through channels in the top of the housing 230, for connection to the power contacts 250. The relay tab ends 260 are located within the contact cavities 270. The terminating ends 262 are routed through the housing 230 to the corresponding shroud 240. The terminating ends 262 are located within the receptacles 242 of the shrouds 240 for termination to the high current power conductors.

Figure 7:
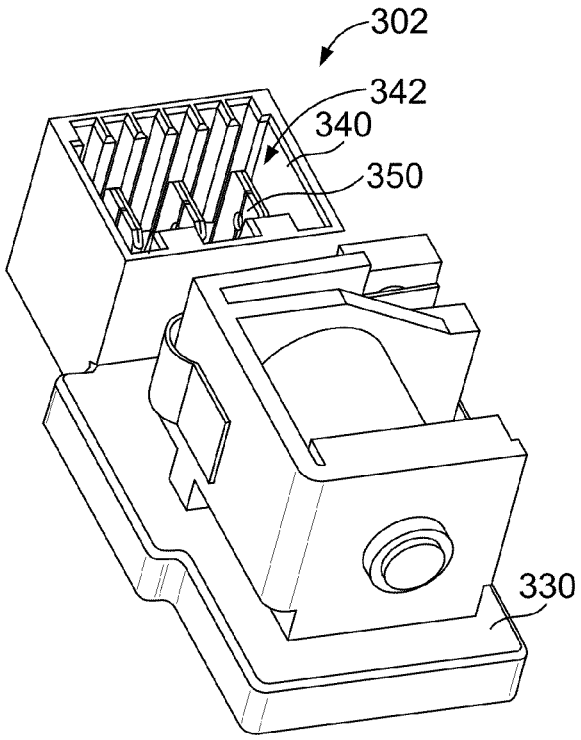
FIG. 7 is a top perspective view of a relay connector assembly formed in accordance with an exemplary embodiment.
Figure 8:
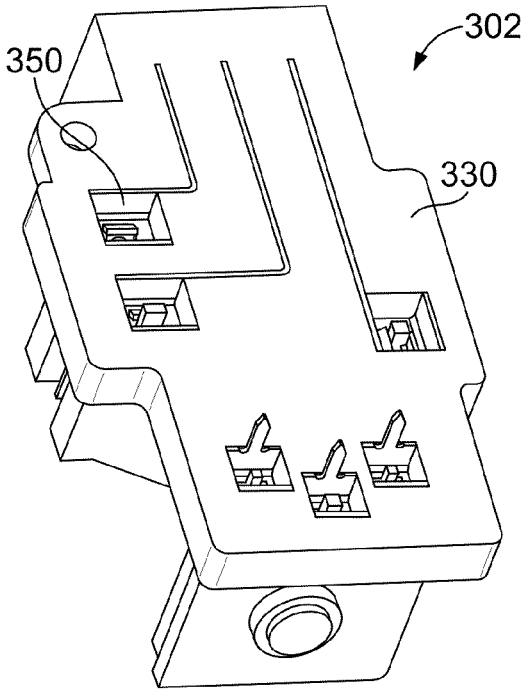
FIG. 8 is a bottom perspective view of the relay connector assembly shown in FIG. 7.

FIG. 7 is a top perspective view of a relay connector assembly 302 formed in accordance with an exemplary embodiment. FIG. 8 is a bottom perspective view of the relay connector assembly 302. The relay connector assembly 302 may be similar to the relay connector assembly 202 (shown in FIG. 5), however the relay connector assembly 302 includes a single shroud 340 and receptacle 342 for mating with the high current conductors of a corresponding power connector plugged into the receptacle 342. Power contacts 350 are routed in the housing 330 differently and the housing 330 has a different shape than the relay connector assembly 202. However, as with the relay connector assembly 202, all of the high current functions are performed off of the circuit board 110 (shown in FIG. 2).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in mean—plus-function format and are not intended to be interpreted based on 35 U.S.C. §112, sixth paragraph, unless and until such claim limitations expressly use the phrase "means for" followed by a statement of function void of further structure.

What is claimed is:

1. A relay connector assembly configured to electrically connect a power supply and a load, the relay connector assembly comprising:

a housing having a bottom configured to be mounted to a circuit board, the housing having contact cavities;

power contacts received in corresponding contact cavities and held by the housing, the power contacts having relay tab ends and terminating ends, the terminating ends having interfaces configured to be terminated to high current power conductors of either the power supply or the load; and a relay coupled to the housing, the relay having coil contacts configured to be electrically connected to a coil circuit of the circuit board used to energize the relay, the relay having relay tabs extending therefrom, the relay tabs being received in corresponding contact cavities of the housing when the relay is coupled to the housing such that the relay tabs are terminated to the relay tab ends of corresponding power contacts, wherein the relay electrically connects corresponding power contacts when the relay is energized.

2. The relay connector assembly of claim 1, wherein the power contacts are separate from the circuit board and are separate from the relay and the relay tabs.

3. The relay connector assembly of claim 1, wherein the power contacts are configured to transmit the high current from the power supply to the load without transmitting the high current to the circuit board.

4. The relay connector assembly of claim 1, wherein the coil contacts pass through the housing and extend below the bottom of the housing for direct termination to the circuit board.

5. The relay connector assembly of claim 1, wherein the housing comprises a mounting lug configured to mount the housing to the circuit board.

6. The relay connector assembly of claim 1, wherein at least one of the housing and the power contacts comprise a solder tab configured to be soldered to the circuit board to mechanically secure the relay connector assembly to the circuit board.

7. The relay connector assembly of claim 1, further comprising coil terminals held in the housing, the coil terminals being terminated to the coil circuit of the circuit board, the coil terminals being terminated to the coil contacts of the relay to electrically connect the coil contacts of the relay to the coil circuit of the circuit board.

8. The relay connector assembly of claim 1, wherein the power contacts are entirely contained within the housing.

9. The relay connector assembly of claim 1, wherein the relay is coupled to a top of the housing and is contained within a footprint of the housing.

10. The relay connector assembly of claim 1, wherein the relay includes a holder holding a core, the coil contacts and the relay tabs, the coil contacts energizing the core to make or break a connection between the relay tabs and the power contacts.

11. A relay system comprising:

a printed circuit board having a relay controller, the printed circuit board having a mounting area, the printed circuit board having conductors defining a coil circuit between the relay controller and the mounting area; and a relay connector assembly mounted to the printed circuit board, the relay connector assembly being configured to electrically connect a power supply and a load, the relay connector assembly comprising:

a housing having a bottom mounted to the mounting area of the circuit board, the housing having contact cavities;

power contacts received in corresponding contact cavities and held by the housing, the power contacts having relay tab ends and terminating ends, the terminating ends having interfaces configured to be terminated to high current power conductors of either the power supply or the load; and a relay coupled to the housing, the relay having coil contacts electrically connected to the coil circuit of the circuit board and being used to energize the relay, the relay having relay tabs extending therefrom, the relay tabs being received in corresponding contact cavities when the relay is coupled to the housing such that the relay tabs are terminated to the relay tab ends of corresponding power contacts, wherein the relay electrically connects corresponding power contacts when the relay is energized.

12. The relay system of claim 11, wherein the relay tabs form part of a high current power circuit, the high current power circuit being separate from the circuit board.

13. The relay system of claim 11, wherein the power contacts are separate from the circuit board.

14. The relay system of claim 11, wherein the power contacts are configured to transmit the high current from the power supply to the load without transmitting the high current to the circuit board.

15. The relay system of claim 11, wherein the coil contacts pass through the housing and extend below the bottom of the housing for direct termination to the circuit board.

16. The relay system of claim 11, wherein the housing comprises a mounting lug with at least one of a fastener and a solder tab for mounting the housing to the circuit board.

17. The relay system of claim 11, wherein at least one of the housing and the power contacts comprise a solder tab soldered to the circuit board to mechanically secure the relay connector assembly to the circuit board.

18. The relay system of claim 11, further comprising coil terminals held in the housing, the coil terminals being terminated to the coil circuit of the circuit board, the coil terminals being terminated to the coil contacts of the relay to electrically connect the coil contacts of the relay to the coil circuit of the circuit board.

19. The relay system of claim 11, wherein the relay is coupled to a top of the housing and is contained within a footprint of the housing.

20. The relay system of claim 11, wherein the relay includes a holder holding a core, the coil contacts and the relay tabs, the coil contacts energizing the core to make or break a connection between the relay tabs and the power contacts.

* * * * *